US012788095B2

(12) United States Patent
Llopis Llinares

(10) Patent No.: US 12,788,095 B2
(45) Date of Patent: Nov. 10, 2026

(54) GOGGLE FRAME AND COUPLING DEVICE

(71) Applicant: Jordi Llopis Llinares, Alicante (ES)

(72) Inventor: Jordi Llopis Llinares, Alicante (ES)

( * ) Notice: Subject to any disclaimer, the term of this patent is extended or adjusted under 35 U.S.C. 154(b) by 51 days.

(21) Appl. No.: 18/270,738

(22) PCT Filed: Oct. 21, 2021

(86) PCT No.: PCT/ES2021/070767
§ 371 (c)(1),
(2) Date: Jul. 3, 2023

(87) PCT Pub. No.: WO2022/144473
PCT Pub. Date: Jul. 7, 2022

(65) Prior Publication Data

US 2024/0292920 A1 Sep. 5, 2024

(30) Foreign Application Priority Data

Jan. 1, 2021 (ES) ..... ES202130001U

(51) Int. Cl.
*A42B 3/18* (2006.01)

(52) U.S. Cl.
CPC ..... *A42B 3/185* (2013.01)

(58) Field of Classification Search
CPC ..... A61F 9/025; A42B 3/185
See application file for complete search history.

(56) References Cited

U.S. PATENT DOCUMENTS 7,805,776 B2 10/2010 Smith et al.
8,245,320 B2 8/2012 Provost et al.
(Continued)

FOREIGN PATENT DOCUMENTS

CA 3206224 A1 8/2022
CN 101119655 B 12/2010
(Continued)

OTHER PUBLICATIONS

Grażyna Bartkowiak, Krzysztof Baszczyński, Anna Bogdan, Agnieszka Brochocka, Anna Dąbrowska, Rafał Hrynyk, Emilia Irzmańska, Danuta Koradecka, Emil Kozłowski , "Use of Personal Protective Equipment", Aug. 13, 2021 https://doi.org/10.1002/9781119636113.ch25 ;https://onlinelibrary.wiley.com/doi/abs/10.1002/9781119636113.ch25.

(Continued)

*Primary Examiner* — Katherine M Moran

(57) ABSTRACT

A goggle frame and coupling device for coupling the goggle frame to a facial aperture of a protective helmet are provided. The goggle frame includes a right side frame magnetic portion and a left side frame magnetic portion on an inner side of the goggle frame or a detachable part thereof. The right side frame magnetic portion and the left side frame magnetic portion are of opposite polarity. The coupling device includes a right side coupling device magnetic portion and a left side coupling device magnetic portion, the right side coupling device magnetic portion and the left side coupling device magnetic portion being attachable to the protective helmet. The goggle frame includes a frame elongation that can be gripped by a user for magnetic disengagement of the goggle frame from the coupling device.

7 Claims, 6 Drawing Sheets

(56) References Cited

U.S. PATENT DOCUMENTS

| | | | | |
|---|---|---|---|---|
| 8,286,269 | B2 | 10/2012 | Springer et al. | |
| 8,286,270 | B2 | 10/2012 | Higgins | |
| 9,072,331 | B2 | 7/2015 | McNeal | |
| 10,912,344 | B2 | 2/2021 | Bohn et al. | |
| 11,019,872 | B2 | 6/2021 | Calilung et al. | |
| 11,064,755 | B1 | 7/2021 | Williams et al. | |
| 2006/0080761 | A1 | 4/2006 | Huh | |
| 2008/0127400 | A1 | 6/2008 | Dupuis | |
| 2012/0328828 | A1* | 12/2012 | McInturff | A61F 9/025 428/131 |
| 2014/0173811 | A1* | 6/2014 | Finiel | A42B 3/04 2/422 |
| 2015/0245682 | A1 | 9/2015 | McGinn et al. | |
| 2018/0190029 | A1 | 7/2018 | Stein et al. | |
| 2019/0113773 | A1* | 4/2019 | Langenwalter | G02C 3/003 |
| 2020/0352271 | A1* | 11/2020 | Whitesell | A61F 9/025 |
| 2021/0212405 | A1 | 7/2021 | Stolker | |
| 2023/0255299 | A1* | 8/2023 | Busch | A42B 3/185 2/15 |

FOREIGN PATENT DOCUMENTS

| | | | | |
|---|---|---|---|---|
| JP | 2012241307 | A | 12/2012 | |
| KR | 100643074 | B1 | 11/2006 | |
| KR | 200447771 | Y1 | 2/2010 | |
| KR | 20120116062 | A | 10/2012 | |
| KR | 102006654 | B1 | 8/2019 | |
| WO | WO-2012047936 | A2 * | 4/2012 | A42B 3/227 |

OTHER PUBLICATIONS

Hong Zhang & Xue Jiang "The Application of Protective Devices in Sports-Related Eye Injuries" Sports-related Eye Injuries, Mar. 11, 2020, pp. 107-119 https://link.springer.com/chapter/10.1007/978-981-13-9741-7_10.

Krzysztof Baszczynski, "Effect of falling weight impact on industrial safety helmets used in conjunction with eye and face protection devices", International Journal of Occupational Safety and Ergonomics, vol. 24, 2018, Sep. 22, 2017, pp. 171-180, https://doi.org/10.1080/10803548.2017.1373987 https://www.tandfonline.com/doi/full/10.1080/10803548.2017.1373987.

Timothy H. Ellis MS, ATC, "Sports Protective Equipment", Primary care: Clinics in office Practice, vol. 18, Issue 4, Dec. 1991, pp. 889-921, https://doi.org/10.1016/S0095-4543(21)00111-1 https://www.sciencedirect.com/science/article/abs/pii/S0095454321001111.

* cited by examiner

GOGGLE FRAME AND COUPLING DEVICE

FIELD OF THE ART

The present invention relates to the sector of protective goggles used as a complement to protective helmets and particularly to motocross goggles used as a complement to motocross helmets.

BACKGROUND OF THE INVENTION

Protective goggles used for the practice of motocross are used as a complement to protective helmets comprising a facial aperture that leaves the part of the face corresponding to the eyes uncovered, namely the eye sockets and the nasal septum, which the goggles protect. More specifically, motocross helmets are characterized by comprising an elongated visor to protect the eyes from the sun's rays and also a prominent chin guard to protect the mouth and jaw from the impact of roost thrown from the rear wheel of other motorcycles and also in the event of a fall. The visor is disposed above the facial aperture of the helmet shell, and the chin guard covers the facial aperture of the helmet shell in its lower half, from the height of the cheeks to the chin, remaining in front of the rider's face without touching it. There are also other sports that use protective helmets without a chin guard and that also use goggles as a protective complement, such as trial, skiing or snowboarding.

Protective goggles for protective helmets in general and motocross helmets in particular known in the state of the art comprise a frame with a single panoramic lens, called goggle shield. Most commonly, the goggle further comprises an elastic band or strap as the means of attachment to the helmet, although there are also other less commonly used methods of attachment. Protective goggles with an elastic headband have been in use for decades, as, for example, Leonard Peter Frieder's patent GB 820,745 discloses. Although they were intended for use as a supplement to protective helmets, there are now sports in which goggles are worn directly on the head, without a protective helmet, for example, in skiing or snowboarding.

The lens inserted in the frame protects the eyes, the nasal septum and the entire eye cavity from the impact of mud, stones, water, air, dust and other external elements present in motocross tracks; while the strap allows the fastening of the goggles on the rider's face due to the tension it produces when put around the shell or outer shell of the helmet. The strap also acts as a gripping means for the goggles while being engaged with the helmet and also for removing them; even for hanging them from the handlebars of the motorcycle, as it allows them to be removed from the facial aperture of the helmet by gripping them by the stretch of the strap which is furthest away from said facial aperture and pulling forward over the shell of the helmet; to put on the goggles, the rider pulls the strap on the two stretches closest to the distal ends of the goggle frame, where the strap is inserted. To do it, the rider has to use both hands, each hand gripping the strap pulling it taut so that the frame can be guided into the facial aperture of the helmet shell. When the goggles are worn directly on the head, they are not removed by pulling on the strap as this causes tugging on the wearer's hair, which is annoying. Instead, the goggle frame is pulled away from the face and here there is the inconvenience that in order to pull the goggle frame, it has to be grabbed by the edges, where the ventilation holes or openings are disposed which are covered by a thin layer of foam that acts as a filter, and which can be damaged. However, to date there are still no known goggles the frame of which comprises gripping means to grip or pull the frame without touching the lens, the other parts that make up the frame or even the strap.

As for the strap used in protective goggles, it has generally been improved over time, for example, by placing longitudinal silicone inserts in the strap which, when in contact with the surface of the shell, produce an anti-slip effect, thereby preventing the strap of the goggles from slipping.

More recently, another way to prevent the strap of the goggles from slipping is by means of a safety device on the back of the helmets, such as that of U.S. Pat. No. 10,258,099 B2.

However, despite such improvements, existing protective goggles for use with protective helmets in general and particularly for motocross still continues to present several problems directly associated with the use of a strap as a means of fastening.

The first drawback is that the strap makes it difficult to fit the goggles over the face. This is because the strap, which is of considerable size, is attached to the distal side ends of the goggle frame so that the rider must stretch it by pulling so that it does not get caught between his face and the goggles themselves, specifically on the inner side of the goggle frame. To prevent this from happening, engaging the goggles in the facial aperture of a helmet requires the use of both hands, one to hold the goggle frame over the face while the other hand pulls the strap over the helmet, stretching it tightly so that the strap wraps around the entire shell of the helmet. The goggles must be gripped at the top and bottom edges of the frame, where the ventilation holes that prevent the goggles from fogging up are disposed and are covered by a thin layer of breathable foam that acts as a filter, so the force used when pulling the frame to get the strap to stretch enough to encircle the shell can damage these air intake openings and cause the goggles to fog up during use. The lower edge of the frame is also where the foam that supports the rider's face is disposed, which can also become soiled or damaged.

Placing the strap around the helmet shell becomes more difficult in motocross helmets since they have an elongated visor portion to protect the eyes from the sunlight exposure. Nowadays, moreover, it is common for these helmets to be used in conjunction with video recording devices that are disposed on the top part of the shell, and therefore the strap has to circumvent these devices making it even more difficult to put on the goggles. At present, there are several well-known sportsmen and women who play sports with a disability consisting of having an amputated hand or arm, for whom it is impossible to put on goggles with a strap as engaging or coupling means.

The reverse process, i.e. uncoupling the goggles from the facial aperture of the protective helmet, while requiring less dexterity is also difficult because the strap is tight against the helmet shell and because the silicone inserts prevent the strap from sliding over the helmet shell, so the rider has to insert the tips of his/her fingers between the strap and the helmet shell. This is even more difficult if the rider has to wear protective gloves, as is the case in motocross or skiing. In addition, and due to its elasticity, the band tends to get tangled with the video recording devices disposed on top of the helmet shell.

Particularly in motocross, there are situations in which the strap makes it really difficult for the rider to remove his goggles. A clear example of this type of situation is during muddy races, where the rider often needs to replace the goggles with clean ones in order to continue. In these situations, the strap—which is made of textile material—accumulates water and mud fragments that make it slippery, making it difficult to grip and remove the dirty goggles. And to put on other clean goggles, the rider has to slide the strap over the surface of the shell, which is full of mud and water, compromising goggle fastening. In addition, the rider may also have to circumvent the video camera and the visor extension. All this accumulation of circumstances in muddy and rainy conditions causes the change of glasses to take a long time that penalizes the position of the rider competing in the race, so it is common to see many riders continuing the race without goggles and with serious difficulties to remove the goggles when they can not see with them, forcing them to stop.

Although a device is known to preserve vision in muddy conditions, such a device consists of stacking thin transparent plastic sheets called tear-offs engaged on the lens that are removed as they become dirty with mud, this system has the disadvantage of having only a limited number of sheets, so due to the duration of motocross races they end up running out, forcing riders to go into the mechanics' area to change the used goggles for others that are ready for use.

Another method to reduce the impact of mud on the goggle lens is to add an extension to the visor, which is usually transparent so as not to reduce visibility, which makes it more difficult to remove and put on the goggles, since the conventional visor is already an obstacle to place the strap on the helmet shell.

The second drawback is that, despite using both hands, the goggles often are not coupled precisely, and may be slightly tilted on the rider's face, which is an obvious discomfort because, being tilted, they press against the eye socket or on part of the nasal septum, which at the same time is a danger due to the partial loss of vision arising thereof. For this reason, the coupling of protective goggles requires the use of both hands in any case.

The third drawback is the difficulty for the rider to remove the strap of the helmet shell when he suffers a hard crash, which usually causes a loss of respiratory capacity due to the impact of the body against the ground. For this reason, it is common to see in cases of a hard crash without loss of consciousness that the first thing the rider does is to try to remove his goggles to try to breathe air. However, sometimes the strap moves downwards and gets caught between the back of the neck and the shell, and the rider has trouble finding it with his hands. In addition, in the most severe crashes with risk of paralysis, the head and neck should not be moved, so it is possible that the strap has been left in a position that makes it difficult to remove the goggles.

The fourth drawback is that when the goggles are not in use, the rider wears them hanging from the forearm or from one of the handlebar grips; this causes the goggles to remain in a horizontal position to the ground as if they were a bag, which causes dust to settle on the inside of the goggles dirtying the lens, or that it remains at the rider's knee, which can hit and scratch the lens. It is also common to see users wearing the goggles inside the helmet when they are holding the helmet in their hand because they have finished skiing or bmx riding, for example. In such cases, there is a risk that the goggles may fall to the ground without realizing it and end up losing the goggles.

The fifth drawback has to do with the durability of these straps, because the elastomers from which they are made lose their properties with use, due to exposure to sun and rain. In addition, because the strap takes up a lot of space and does not retract, when not in use the goggles are stored inside the helmet together with the gloves, and the textile material of the strap deteriorates when it catches on the fastening system of the gloves, mostly hook and loop.

The sixth drawback is of an aesthetic nature, as the strap is continuously exposed to dirt stains as the textile fiber absorbs grease and mud stains, and cannot be separated from the frame for washing. In addition, helmets today are often decorated with graphics that represent an aesthetic element of high value for the consumer, which are covered by a dirty and deteriorated strap. And at the level of professional competition, the helmet shell is a showcase for sponsors, so both consumers and professional athletes are forced to partially cover the shell with the strap of the goggles.

The seventh drawback is one of hygiene, since in order to put on the goggles the rider has to grip the goggle frame on the inside to avoid scratching the lens, and in doing so touches the foams that come into contact with the face and those that act as filters in the face ventilation openings to prevent the lens from fogging up.

A final drawback is associated with environmental conservation, as the straps are composed of a mixture of textile fiber with plastic fabric, so it has no easy recycling, and as with all waste that has a rubber band that closes its two ends on a solid body, it can trap animals if the strap goggles end up in a landfill at the end of their useful life.

In the state of the art there are protective goggles that dispense with the traditional strap as a means of fastening to protective helmets and replace it with other systems.

U.S. Pat. No. 9,072,331B2 shows a system using two strap portions with two fastening devices at their ends that attach to two base portions that attach to the helmet shell, one in a fixed manner and the other by means of a hook and loop system so that the goggles are always attached on one side, hanging from the helmet shell, allowing the fixation of goggles on helmets and their subsequent release with only one hand. This system is designed for enduro riders, for moments when the rider has to remove the goggles because the rider has stopped to examine the difficulty of a section of the ride and thus avoid fogging; however, this system has several disadvantages since firstly the anchoring system is exposed to breaking by impact of the helmet given its location on the shell; secondly, the rider has to be familiar to guess the exact location of the support with hook-and-loop system; thirdly, this system requires the rider to remove the helmet to completely separate the goggles from the helmet, for example when it is necessary to clean the inside of the lens because it hinders vision; and a final drawback is imposed by the hook and loop system used, since with use it loses its qualities and exposure to water and mud also diminishes its fastening capacity.

Patent application PCT US2005/002214-WO 2005/070359 describes anti-fog goggles using fastening means similar to the one shown in U.S. Pat. No. 9,072,331B2 which dispenses entirely with the conventional strap. To that point, engaging means are provided by way of an adjustable "U" shaped elastic cord that engages the side walls of the goggles at both distal ends and wraps around a helmet holder adapted to engage the cord. A second means provided features one or more projecting pins that engage apertures in the facial aperture of the helmet and hold the goggle on the face of the user with its contoured top and sides engaging the facial aperture of the helmet.

U.S. Pat. No. 6,845,548B1 shows an attachment system for protective goggles by means of a buckle that engages a portion that is disposed on the outer shell of the protective helmet.

However, the main drawback of these methods is that they require the simultaneous use of both hands to place the goggles over the facial aperture of the protective helmet, since one hand must hold the goggles over the face while the other hand is used to operate the fasteners. Another drawback is that the latching elements are exposed to mud, which is an element present in motocross riding that can get trapped in the latching areas and prevent dirty goggles from being quickly replaced with clean ones. On the other hand, the U-shaped elastic cord is hooked into supports arranged on the helmet shell and is therefore exposed to breaking due to impact, on the one hand, and on the other hand, the elasticity of the cord is lost with use and exposure to inclement weather. On the other hand, the use of mechanical means of fastening has the problem that they are prone to jamming, either by debris settling in the openings where they are installed, or by breakage of the mechanisms due to impact in the event of a crash, or by rusting of the retaining springs. The final drawback of this system is that goggles with these fastening systems are not designed to be hung on the handlebars of the motorcycle when not in use or on any other element other than the protective helmet to which they are fitted.

Magnets have long been used as a means of coupling and quick release of objects on ferromagnetic surfaces thanks to their magnetism, considered as the ability to attract the opposite poles of other magnets or other ferromagnetic bodies. The use of magnets is also known in the prior art, for example in eyeglasses, to hold together different sections of the frame, which facilitates disassembly and assembly in a new configuration, with auxiliary frames, lenses or the like.

U.S. Pat. No. 6,168,273B11 shows the use of magnets in eyeglass frames to temporarily affix the eyeglasses to a support article having magnetic means.

More recently, patent US20140043682A1 shows the use of magnets in goggles as a means of coupling and quick release of the lens to the frame and from the frame, for lens replacement.

Patent EP3284360 claims a pair of magnets attached to a pair of elastic rubber cylinders through which go the temples of universal frame glasses such as those used for cycling, so that the magnets are attached to the temples and thus the glasses can be fixed to any ferromagnetic surface which in this case is disposed on the shell of the bicycle helmet or the handlebars of the bicycle, all of this to prevent the lenses from scratches while the glasses are not in use. The problem with this invention is discomfort, since it is intended for universal frame glasses with rods to which the magnets are attached, which is uncomfortable for the rider, as well as visibly unaesthetic. Indeed, universal frame glasses can only be used with specific cycling helmets where the ears are not covered. This same patent claims a cycling helmet that has magnets on the helmet shell to attach glasses with temples equipped with magnets, so that the rider can wear the glasses on the helmet when not in use and in a position that prevents the glasses lenses from coming into contact with the shell, so that they do not get scratched. Therefore, this invention has the same drawback as the shell is exposed to impacts, especially with crashes, and the magnets must protrude above the shell in order to support another magnetized object, so that they can easily break.

Patent EP2305053B1 shows the use of magnets for coupling a frameless goggle to a ski helmet, by means of two permanent magnets disposed on the helmet shell on the part that covers the temples, which connect with two magnets attached to the ends of two cords attached to the goggle's lens, which allows the goggles to hang from one of the cords attached to the helmet shell when not in use, and thus the rider prevents them from fogging up, while at the same time they can be easily put on with one hand.

However, this invention presents two obvious problems: the first of them is that the fastening means disposed on the outer surface of the helmet are exposed to breaking due to impacts caused by crashes, and can also come loose and the goggles can be lost; and the second of them is that in order to put on the goggles the lens must be gripped, thus making it dirty and subject to scratches. This invention also refers to the use of cone-shaped magnets as a way of centering the glasses, however, this presents an obvious problem because a cone-shaped base becomes a cavity that allows unwanted elements such as mud debris to get inside the magnet and impair its magnetic properties, while it is difficult to clean without the appropriate means.

Protective helmets for motorcycling, bmx, skiing or snowboarding generally consist firstly of an outer shell, generally made of synthetic fibers such as aramid, carbon or glass, which receives, supports and distributes the impact, and secondly of an inner shell, generally made of expanded polystyrene foam (EPS), which protects the head and has the shape of a cap; in this type of helmet, and contrary to what happens with cycling helmets, the edges of the expanded polystyrene foam that protrude through the facial aperture of the helmet are covered by a molded plastic layer that acts as a protector and as an embellisher or termination of the edges of the EPS, although some helmet models also use it as a wind diffuser towards the inside of the helmet. And thirdly, this type of helmet is composed of an inner padding with lining, whose main function is to properly fit the helmet to the head so that the helmet is comfortable to wear. For a long time the inner padding was a fixed part of the helmet and could not be removed, but nowadays practically all helmets have a removable and washable inner padding. This is achieved thanks to a semi-rigid plastic structure in the form of a plate that is attached to the surface of the inner shell by means of different systems that allow its release, and on top of this structure are disposed several elongated plates of polyurethane foam or similar of different widths covered with a washable lining that cover the head like a cap, leaving gaps between them to promote ventilation. Even so, inclement weather and wear-out by use inevitably cause the inside of the helmet to break down and cease to be as comfortable as in the first use, and more importantly, to cease to be safe.

Another element of the internal padding aside from the above is a pair of right and left inner cheek pads for the rider's cheeks. These inner cheek pads are formed with plate-shaped bodies generally made of polyurethane foam or similar with different densities cut in three dimensions, and are attached to a semi-rigid plastic structure with the same plate shape that adheres to the inner surface of the shell by different means that allows its release to be able to wash the dirt accumulated by use or even to facilitate the removal of the helmet in case of an accident. For example, U.S. Pat. No. 10,238,164B2 shows the use of magnets in protective helmets as a system for fastening and quick release of the pads that protect both sides of the rider's jaw in the event of an accident.

At present, magnetic products of different shapes can be obtained by injecting magnets into different types of plastics.

In spite of all the drawbacks described in the prior art, there are no known strapless goggles for protective helmets which can be totally decoupled from the helmet and which can be hung on the handlebar or on a ski pole or on any other element provided for this purpose, for example, a decorative carabiner-type hook on a pair of pants or a sports jacket.

There are no known goggles that allow dirty goggles to be exchanged for clean ones in the shortest possible time, for example, during a muddy motocross race.

There are no known goggles with a fastening system that allows the goggles to be engaged in the facial aperture of the helmet in a perfectly centered position, since the use of the strap is not capable of fulfilling this function on its own, but requires dexterity and of course the use of both hands.

There are no known goggles provided with a frame that is intended to facilitate engagement in the facial aperture of protective helmets and their subsequent disengagement with only one hand and without the hand coming into contact with the lens or with sensitive areas, for example, where the openings for air intake or the foam band disposed on the inner side of the frame that comes into contact with the face of the user or athlete are disposed.

There are no known protective goggles for use with protective helmets that replace the strap with magnetic attachment means; nor are there known magnetic attachment means to replace the strap as an attachment means for protective goggles for use with protective helmets.

There are no known helmet inner shells comprising magnetic coupling means that allow the engagement and disengagement of strapless goggles or of a goggle frame to its facial aperture. The same applies to their inner shell parts, such as the inner shell (EPS) and the padding.

SUMMARY

In order to avoid all the drawbacks described in the preceding paragraphs, the present invention proposes a goggle frame and a device for its coupling to the facial aperture of protective helmets in general and of helmets for the practice of any modality of motocross in particular, wherein the goggle frame comprises gripping means and means for magnetic coupling, and wherein the device for its coupling comprises means for magnetic coupling and means for attachment or adhesion to the inside of the helmet within the area of facial aperture disposed to fit the goggles on the rider's face.

Both the goggle frame and the device for its coupling to the facial aperture of protective helmets comprise magnetic coupling means composed of a magnetic or magnetizable portion which is separately or inseparably attached to a base portion, which in the case of the frame may be the frame itself or any detachable part thereof; and which in the case of the device may be configured as an element of those present inside protective helmets and in any case outside the surface of the outer shell, for example an expanded polystyrene (EPS) liner, or an independent piece made of light and resistant material that can be attached to that same area, for example by means of a band of high-strength glue on both sides, so that it is already present on the base portion and can be attached to the inside of the helmet on the unused side.

The features of the proposed invention solve the problems presented by protective goggles for use with protective helmets which employ a strap as a means of fastening and also the problems presented by protective goggles which employ the other aforementioned fastening devices for coupling to the facial aperture of protective helmets and the frame of which does not present gripping means.

The incorporation of magnetic attachment means in the goggle frame and in the proposed device makes it possible to attach the goggle frame to the facial aperture of protective helmets that do not have magnetic attachment means and incorporate the device, while the proposed goggle frame alone can be attached to any other type of helmet that already incorporates magnetic attachment means arranged correlatively to create a magnetic attraction field with said frame.

The magnetic attachment means comprised in the proposed goggle frame are detachably or inseparably attached to the inner side thereof, protected from possible impacts, and comprise one or more magnetic or magnetizable portions, preferably flat, and may cover any shape, for example rectangular; moreover, they may be attached to the frame by means of any magnetic or magnetizable means.

Preferably the magnetic attachment means comprise two magnetic or magnetizable portions disposed at both lateral ends of the frame on its inner side, which are joined in a separable or inseparable manner. By "inner side" of the frame is meant the part of the frame which surrounds the lens and which during use is positioned internally, i.e. opposite to the outer part of the frame which is exposed to wind, rain, snow or mud, among other elements.

Since the strap also acts as a means of gripping the goggles while in use with a helmet and also to remove them and even to hang them from the handlebars of the motorcycle, it is necessary to provide the goggle frame with means of gripping that fulfill this same function but without generating the problems described, so as to allow the rider to pull the goggle frame forward with sufficient force to overcome the magnetic attraction of the magnetic attachment means of the coupling device and thus disengage it from the facial aperture of the helmet, or simply to be able to leave it hanging from the handlebars of the motorcycle. This is achieved by an elongation on either side of the frame face outward, outside the field of vision encompassing the entire lens. By "outer side" of the frame is meant the part of the frame that during use is positioned externally, i.e. exposed to the outside. Said elongation may have any shape that allows the frame to be gripped, for example, a curved shape like that of a shoehorn so that a free space is left between the helmet shell and the gripping means into which the fingertips can be inserted to release the frame from the helmet's facial aperture. The tongue may have a hole that gives it a handle-like shape, such as a cup, and allows the rider to grip the goggles only by inserting a finger into the hole and pulling on the frame. The hole may be of sufficient diameter to allow the handlebar grip of a motocross motorcycle to pass through for temporary hanging of the goggles when not in use, thereby also replacing the traditional strap as a means of hanging the goggles from the handlebars of a motorcycle. The diameter of the hole can be adapted according to the object to be let through, for example, on children's motorcycles it will be a smaller diameter, or for attaching the goggles to devices fixed for this purpose, such as a decorative carabiner-type hook on pants or sports jackets.

In a similar manner, the strap comprised in the prior art is also used by the rider to engage the goggles into the facial aperture of the protective helmet, which is achieved by pulling the two stretches of the strap which are closest to the insertions in both sides of the goggle frame putting them in an engaged position in front of the opening of the protective helmet and taking care that the remaining stretch of the strap passes over the shell, thus making it necessary to provide the frame with gripping means to allow the frame to be engaged in the facial aperture of the protective helmet in the most comfortable, clean and safe manner possible.

The engaging or coupling of the goggles in the facial aperture of the protective helmet can be done by holding the goggle frontally or by one of its sides depending on the taste of each rider, but always with the inner side of the frame facing the facial aperture of the helmet. Therefore, although a single outward elongation in the form of a tab is sufficient to hold the goggles without touching sensitive parts of the goggles, the frame can be provided with additional gripping means, also disposed on the outer side of the frame, outside the field of vision, which can be in any form that allows the rider to hold the proposed goggle frame with only one hand, either gloved or bare, for example with the thumb and middle finger, without touching the most sensitive parts of the goggles, such as the foams or padding that come into contact with the rider's face, the ventilation openings and the lens, keeping the goggles free of dirt and small elements that when coming into contact with the lens could scratch it, such as fragments of mud or stone that could be stuck on the gloves; these gripping means can even act as means of hygiene, since without these gripping means the goggle frame part of the foam that comes into contact with the rider's face is often touched with the fingers.

In one embodiment, the goggle frame comprises an elongation on the outer right side in the shape of a shoehorn with a circular hole at its distal end.

In another embodiment, the goggle frame comprises one or more additional elongations at the top of the outer side. Preferably, these additional elongations are two in the manner of two small antennae that allow the goggles to be gripped and attached to the facial aperture of the helmet with one hand and without touching the lens.

The proposed goggle frame can fit a single, panoramic eyepiece, although it can also be made to house two independent eyepieces, in the manner of aviator goggles, without losing the essence of the proposed invention.

Similarly, the proposed goggle frame can incorporate pivots for the attachment of additional devices and/or accessories to mitigate mud and water impacts on the lens, thus improving the existing state-of-the-art goggles that place these devices on the lens, within the pilot's viewing area.

In another embodiment, the proposed protective goggle frame may be configured in two bodies mechanically joined by any means known in the art, such that the gripping means are in one body which will coincide with the outer side or face of the frame while the magnetic attachment means are separately in the other body which will coincide with the inner side or face of the frame. With this division, the service life of the frame is increased since, if either of the gripping means is damaged by a fall or stone impact they can be replaced and keep using the magnetic attachment means, which is the most expensive part to manufacture.

On the other hand, the device for coupling the goggle frame to protective helmets consists of one or more bodies of reduced size to be disposed on the inside of the protective helmets in a way imperceptible to the user, and thus solve the problems arising from their location on the outside, such as breakage due to impacts from stones, mud and falls. Each body comprises a magnetic or magnetizable portion preferably flat and a base portion which is configured to be adhered or attached to the protective helmet, so that it can cover any shape that allows its location in the area of the facial aperture where the protective glasses are engaged during use.

In the present invention, the device for coupling the frame is presented as an element interrelated with the proposed protective goggle frame, which once incorporated inside the protective helmet allows the temporary attachment of the frame thanks to the magnetic or magnetizable material comprised in the preferably flat portion of the device for coupling, which we will refer to as the magnetic portion, which is attached separably or inseparably to the base portion, which is the portion that is attached to the protective helmet. But it could also be considered that the device is a magnetic attachment means in its entirety, for example if it is understood as an integral element of a protective helmet which in that case would comprise magnetic attachment means, so that to explain the object of the present invention we refer indistinctly to magnetic attachment means and to magnetic or magnetizable portions, where both refer to the same thing; Thus, for example, the magnetic or magnetizable portion which is attached to a base portion constitutes the magnetic attachment means of the proposed device, and the base portion which is attached to the magnetic or magnetizable portion constitutes the means of adhesion to the inside of the helmet shell if it is configured as a snap-fit part, or may have means of adhesion such as a high strength glue if it is configured for use in helmets already on the market.

As stated, the base portion is what fixes the device object of the present invention to the protective helmet, and thus in the description refers to those base bodies as means of fixation or attachment to the area of the facial aperture of the protective helmets, since their shape is configured to attach separately or inseparably to the inner liner of the helmet or to the inner area of the shell, for example as an elastomer finish covering the impact-absorbing inner liner.

In order to achieve the removably coupling with the proposed goggle frame, both the proposed coupling device and the frame comprise magnetic attachment means arranged to create the necessary magnetic attraction with the proposed frame. Removably coupling means of a magnetic attraction field requires that the magnetic attachment means also comprise one or more magnetic or magnetizable portions, the number, shape, location and polarity of which will be correlative to the magnetic attachment means present on the proposed goggle frame, for example it will have two rectangular shaped, flat surface magnetic portions disposed at both ends of the facial aperture of the helmet if the frame comprises two rectangular shaped, flat surface magnetizable portions disposed at both ends of the frame. This is the only way to ensure that the magnetic attachment means are perfectly joined when attracted, and they will also have to be symmetrically positioned so that no deformities are produced in the portions of the body to which they are attached.

Obviously, to achieve the removably coupling between the frame and the device it is required that the magnetic fixation means of the device, once attached or fixed to the protective helmet, maintain a polarity opposite to that of the magnetic fixation means arranged on the frame, so that they attract each other until they are perfectly joined, otherwise the device would repel the frame and the goggle frame could not be fixed or coupled. Correlatively, if the frame or the device employs magnetizable or ferromagnetic materials, in that case when the magnetic attachment means of the device contain magnetic portions or bodies, the magnetic attachment means of the frame must contain magnetizable portions or bodies, and vice versa, so that a magnetic attraction is always created.

The magnetic attraction thus allows the goggle frame to be coupled and uncoupled effortlessly with just one hand. The attraction between the bodies generated by the magnetism is what makes it possible to guide the goggle frame effortlessly and almost autonomously into place and at the same time keep the goggles fixed or clamped in the corresponding part of the helmet's facial aperture, perfectly centered to the millimeter. At the same time, the goggles can be detached by pulling on the handle without having to use dexterity to remove the strap.

The bodies that make up the coupling device have a portion with a preferably flat surface made of plastic material that serves as a support for housing the magnet, preferably injected, or for housing the magnetizable body if necessary, and is the one that comes into contact with the magnetic attachment means comprised in the proposed goggle frame, This portion must therefore face away from the facial aperture of the helmet as a wall, in order to receive the magnetic or magnetizable portions disposed correlatively at the ends of the proposed goggle frame, thus ensuring that the goggles are perfectly centered automatically without the need for the pilot to use skill to achieve a precise coupling.

As has been said, the rest of the coupling device is formed by a base portion that constitutes the means of fixation or adhesion to the inner area of the protective helmet, so as to allow the magnetic attachment means of the device to be disposed in the area of the facial aperture to receive the proposed goggle frame. This base portion can be individual when the device is formed by more than one body, or shared when the device is formed by a single body having two or more magnetic or magnetizable portions, depending on the possibilities offered by each model of protective helmet. For example, the coupling device may be configured as two equal but autonomous bodies, where each contains a magnetic portion attached to a base portion having the flat shape of a simple pendulum where the flat circle adheres to the inner side of the protective helmet shell and the linear portion of the pendulum lies between the central padding of the helmet and the side pads, leaving the magnetic or magnetizable portion exposed in the facial aperture of the protective helmet over the sides of the helmet padding, or it may be configured as the protective rubber lining covering the edges of the shell.

To achieve the necessary fixation inside the helmet, the device can also take a form as an appendix of any of the elements that make up the interior of the protective helmets, such as the inner shell, the inner liner, the padding or even the side pads. For example, the base portion could be configured the same as the base plate of the padding of the side pads but with an extension or elongation that would be the linking or connecting nexus with the magnetic or magnetizable portion, so that when the padding is inserted inside the helmet, the magnetized or magnetizable section or portion is at temple level to receive the magnetic attachment means comprised in the proposed protective goggle frame. More simply, the device can take the form of any integral element of the interior of the helmet having a merely decorative, aesthetic or finishing function, to instead perform the function of magnetic coupling means.

Advantageously, it is possible to take advantage of the repulsion that occurs when equal poles face each other, so that the goggles only create a magnetic field with the device housed inside the protective helmet if they are in the correct position, and if the goggles are not engaged in the correct position, for example inverted, the magnets arranged to attract those will repel the goggles instead of attracting them. Similarly, the effect is achieved that one side of the frame is not magnetically attracted in the wrong place on the opposite side of the helmet, so that the rider can insert the frame through one side of the facial aperture of the helmet without danger of the magnet on one of the sides being prematurely attracted before the frame is fully positioned over the rider's face. In doing so, the polarity of the magnets is used as a measure to ensure the correct position of the goggles on the rider's face when using a protective helmet such as those used for motocross. And while it is true that these problems are solved by employing a single magnetic portion, for example centered at the top of the facial aperture of the helmet and at the top of the goggle frame arranged correlatively, this invention intends to replace the strap as a means of attachment without changing the effect or feeling that the rider has with it, that is, by pulling on both sides of the goggle frame, and therefore the preferred mode of realization employs a magnetic portion on each side instead of a single centered one.

The plastic used to form the magnetic attachment means has a variable stiffness and elasticity that can be the same for the whole body or different for each portion that make it up, for example in the frame of protective glasses the magnetic portions will have the same plastic used to form the inner side of the frame since it acts as the base portion, while in the device the magnetic or magnetizable portion will have greater stiffness than the base portion if it is configured as the base plate of the central padding. there are two reasons for using plastic with different degrees of elasticity and stiffness: the first is that plastic is an easily moldable material, and in fact it is the material used to manufacture the frame of the protective goggles present on the market and also of the various elements present inside the protective helmets, for example the bodies that make up the base of the padding inside the protective helmets or the lining of the edges of the shell made of fiber, among which are those edges that delimit the facial aperture of the protective helmet; and, secondly, because the plastic allows the injection of magnets, and thus magnetic bodies can be created in the shape of any of the plastic elements used inside the helmets, while avoiding the use of magnets as adhered bodies that can separate from their support due to a strong impact. The dimensions of the injected magnet bodies may vary depending on the magnetic strength of the injected magnet. The magnets should be small and powerful, e.g. neodymium, coated with protective material or not, e.g. with a thin layer of thermoplastic elastomer.

The reason why the magnetic attachment means of both the goggle frame and the coupling device have a preferably flat surface is due to the fact that the cavities can house dirt that interferes with the magnetism weakening it, and because they are also easier to clean; although it is possible to make them with relief as male and female if you want to obtain a superior fixation, for example for other sports in which there are no conditions of dirt.

In one embodiment, the coupling device can have its magnetic or magnetizable portions duplicated separately to fix the frame on other surfaces on which the goggles can be left at rest, for example, on the protective foam of the handlebars of the motorcycle or on the sleeve of the ski jacket, for which these duplicated magnetic or magnetizable portions must have means of adhesion to adhere, for example a high adhesion and waterproof adhesive.

In another embodiment, the coupling device comprises at least one magnetic section or portion attached to the base portion by manually adjustable extension means for adjusting the coupling of the proposed goggle frame to the facial aperture of the protective helmet, so that the inner part of the frame rests on the rider's face without excessive pressure, since each rider has his own facial features.

In another embodiment, the magnetic portion of the coupling device is detachably attached to the base portion, to allow its replacement, for example, to vary the magnetic strength of the device.

In another embodiment, the magnetized flat surfaces are attached to a base portion in the form of a base plate of the side protective pads, separably or inseparably, and have extension adjusters.

In another embodiment, the coupling device has at least two magnet-injected magnetized flat portions each attached to a "T" shaped base portion that engages the edge of the inner liner (EPS) at temple height, which may or may not comprise extension adjusters.

In another embodiment, the coupling device has at least two flat portions magnetized by means of an injected magnet attached in a separable or inseparable manner to a single pendulum-shaped flat portion that is attached to the inner side of the shell at temple height, which may or may not comprise extension adjusters.

In a preferred embodiment, the coupling device comprises at least two flat portions magnetized or magnetizable by means of injected magnet attached to the same base portion with a transverse "U" shape configured as a protective rubber profile to cover the edges or terminations of the shell, with self-adhesive interior to adhere as a clamp to the ends of the shell that delimit the facial aperture of the helmet, so that the flat magnetized or magnetizable portions are disposed at the top of the left and right sides of the facial aperture area.

In another embodiment, the coupling device comprises at least two bodies of light and resistant material, for example plastic, each composed of a flat rectangular portion magnetized by means of an injected magnet which are separately or inseparably attached to a "U" shaped base portion such as the profile rubber covering the edges or terminations of the shell at the height of the sides of the facial aperture. In turn, the plastic body can be attached to the helmet by means of a simple wide-head screw such as those used to separately attach the visor to the helmet shell, or it can be configured as an inseparable part of the profile rubber that comes with the helmet from the factory or for later replacement, or it can be superimposed on the plastic portion of the helmet by means of a high-strength adhesive strip. When the bodies containing the magnetized portions are separately attached to the base portion, this allows to exchange them for other portions with a different thickness, so that the frame always remains on the face of the user or pilot in a comfortable way, without excessive pressure.

With the above particularities, the present invention offers a set of strapless protective goggles that allow the rider to engage them to the facial aperture of the protective helmet in the exact position with only one hand, without dirtying the lens and in extraordinarily reduced time; likewise, it allows the rider to remove them with only one hand by simply pulling them frontally towards the outside of the helmet, with the possibility of leaving them anchored to any of the grips of the handlebars of the motorcycle. In muddy races, it allows riders to change goggles during the course of the event, drastically reducing the time it takes to remove the goggles and put on new ones ready for use.

Similarly, the proposed invention is also applicable for other sports such as snowboarding, skiing, bmx, etc.

In short, the set of goggle frame and device for its coupling to the facial aperture of helmets proposed solves each and every one of the problems mentioned above, resulting in more competitive goggles for helmets, because they can be replaced during a race by in a few seconds; more durable, because they dispense with the fastening elements that are disposed on the helmet shell and are exposed to breakage due to impact, and because they dispense with the strap, which is a fastening element which wears out easily; more precise, because they can be fitted to the helmet with total precision practically by themselves, by bringing them close to the facial aperture of the helmet with just one hand; more efficient, because they can be fitted using only one hand and removed with only two fingers of one hand; more comfortable, because they can be coupled using only one hand; more comfortable, because they can be hung on the handlebars, or attached to the rider's clothing or other parts of the motorcycle, and can be stored more loosely in their protective bag without the discomfort of the bulky strap; more practical, because they allow the user to wear them attached to the helmet when carrying the helmet in the hand before or after use; more modern, because when attached to the helmet's facial aperture the goggle frame itself hides the means of attachment and allows the graphics on the helmet to be displayed or to give exposure to the athlete's sponsors; safer, because they help to prevent the rider's neck from moving in the event of a serious crash; more ecological, because they do not use an strap, a non-recyclable element and the main cause of goggle replacement due to deterioration; and finally, suitable for disabled athletes, as they are the only protective goggles suitable for riders and athletes with a partially or totally amputated hand or arm.

A goggle frame and coupling device for coupling the goggle frame to the facial aperture of protective helmets, is characterized in that both, goggle frame and coupling device, comprise magnetic attachment means which are arranged correlatively to create a magnetic attraction sufficient to allow the magnetic coupling of the one with the other, the goggle frame being further characterized in that it comprises gripping means and the coupling device being further characterized in that it consists of one or more bodies comprising a base portion configured to be wholly or partially disposed in the facial aperture of the protective helmet and in that it comprises means for fixation or adhesion.

A goggle frame is releasably attachable to the facial aperture of protective helmets provided with a coupling device comprising magnetic attachment means for the attachment, characterized in that the goggle frame comprises magnetic attachment means arranged correlatively with the magnetic attachment means comprised in the coupling device of the helmet to create a magnetic attraction sufficient to allow magnetic releasable coupling between the goggle frame and the coupling device and wherein the goggle frame is further characterized in that it comprises griping means.

A coupling device for coupling of a goggle frame to the facial aperture of protective helmets, the goggle frame being provided with magnetic attachment means, characterized in that the coupling device comprises magnetic attachment means arranged correlatively with the magnetic attachment means comprised in the goggle frame and in that it consists of one or more bodies comprising a base portion configured to be wholly or partially disposed in the facial aperture of the protective helmet comprising fixation or adhesion means.

A goggle frame and coupling device for coupling the goggle frame to the facial aperture of protective helmets, is characterized in that both, goggle frame and coupling device, comprise magnetic attachment means which are arranged correlatively to create a magnetic attraction sufficient to allow the magnetic coupling of the one with the other, the goggle frame being further characterized in that it comprises gripping means and the coupling device being further characterized in that it consists of one or more bodies comprising a base portion configured to be wholly or partially disposed in the facial aperture of the protective helmet and in that it comprises means for fixation or adhesion, further characterized in that the magnetic attachment means comprise at least one portion with magnetic or magnetizable material with its surface having a fitting shape with its correlative portion, that in the case of the goggle frame the portion is separably or inseparably attached to the inner part or face of the goggle frame and that in the case of the coupling device it is separably or inseparably attached to the base portion.

A goggle frame and coupling device for coupling the goggle frame to the facial aperture of protective helmets, is characterized in that both, goggle frame and coupling device, comprise magnetic attachment means which are arranged correlatively to create a magnetic attraction sufficient to allow the magnetic coupling of the one with the other, the goggle frame being further characterized in that it comprises gripping means and the coupling device being further characterized in that it consists of one or more bodies comprising a base portion configured to be wholly or partially disposed in the facial aperture of the protective helmet and in that it comprises means for fixation or adhesion, further characterized in that the magnetic attachment means of the goggle frame comprise a magnetic portion disposed at the right end of the inner side of the goggle frame and another magnetic portion disposed at the left end of the inner side of the goggle frame, wherein said magnetic portions are separably or inseparably attached to the inner side of the frame and have an opposite polarity to each other, and characterized in that the magnetic attachment means of the coupling device comprise two magnetic portions with opposite polarity to each other which are arranged to have in turn an opposite polarity with the magnetic portions disposed on the goggle frame, the magnetic portions being separably or inseparably attached to the base portion which is shaped like a protection rubber with a "U" cross-section for adhering to the edge of the shell of the protective helmet and which are disposed at the both sides of the facial aperture, wherein the magnetic portions of the frame have surfaces having a shape which fits completely with the surfaces of the magnetic portions of the coupling device.

A goggle frame and coupling device for coupling the goggle frame to the facial aperture of protective helmets, is characterized in that both, goggle frame and coupling device, comprise magnetic attachment means which are arranged correlatively to create a magnetic attraction sufficient to allow the magnetic coupling of the one with the other, the goggle frame being further characterized in that it comprises gripping means and the coupling device being further characterized in that it consists of one or more bodies comprising a base portion configured to be wholly or partially disposed in the facial aperture of the protective helmet and in that it comprises means for fixation or adhesion, further characterized in that the magnetic attachment means of the goggle frame comprise a magnetic portion disposed at the right end of the inner side of the goggle frame and another magnetic portion disposed at the left end of the inner side of the goggle frame, wherein said magnetic portions are separably or inseparably attached to the inner side of the frame and have an opposite polarity to each other, and characterized in that the magnetic attachment means of the coupling device comprise two magnetic portions with opposite polarity to each other which are arranged to have in turn an opposite polarity with the magnetic portions disposed on the goggle frame, the magnetic portions being separably or inseparably attached to the base portion which is shaped like a protection rubber with a "U" cross-section for adhering to the edge of the shell of the protective helmet and which are disposed at the both sides of the facial aperture, wherein the magnetic portions of the frame have surfaces having a shape which fits completely with the surfaces of the magnetic portions of the coupling device, further characterized in that the magnetic portions are obtained in elastomer material with injected magnet.

A goggle frame and coupling device for coupling the goggle frame to the facial aperture of protective helmets, is characterized in that both, goggle frame and coupling device, comprise magnetic attachment means which are arranged correlatively to create a magnetic attraction sufficient to allow the magnetic coupling of the one with the other, the goggle frame being further characterized in that it comprises gripping means and the coupling device being further characterized in that it consists of one or more bodies comprising a base portion configured to be wholly or partially disposed in the facial aperture of the protective helmet and in that it comprises means for fixation or adhesion, further characterized in that the magnetic attachment means of the goggle frame comprise a magnetic portion disposed at the right end of the inner side of the goggle frame and another magnetic portion disposed at the left end of the inner side of the goggle frame, wherein said magnetic portions are separably or inseparably attached to the inner side of the frame and have an opposite polarity to each other, and characterized in that the magnetic attachment means of the coupling device comprise two magnetic portions with opposite polarity to each other which are arranged to have in turn an opposite polarity with the magnetic portions disposed on the goggle frame, the magnetic portions being separably or inseparably attached to the base portion which is shaped like a protection rubber with a "U" cross-section for adhering to the edge of the shell of the protective helmet and which are disposed at the both sides of the facial aperture, wherein the magnetic portions of the frame have surfaces having a shape which fits completely with the surfaces of the magnetic portions of the coupling device, further characterized in that the griping means comprise at least one elongation disposed outwardly at the lateral ends of the frame outside the visual space of the lens.

A goggle frame and coupling device for coupling the goggle frame to the facial aperture of protective helmets, is characterized in that both, goggle frame and coupling device, comprise magnetic attachment means which are arranged correlatively to create a magnetic attraction sufficient to allow the magnetic coupling of the one with the other, the goggle frame being further characterized in that it comprises gripping means and the coupling device being further characterized in that it consists of one or more bodies comprising a base portion configured to be wholly or partially disposed in the facial aperture of the protective helmet and in that it comprises means for fixation or adhesion, further characterized in that the magnetic attachment means of the goggle frame comprise a magnetic portion disposed at the right end of the inner side of the goggle frame and another magnetic portion disposed at the left end of the inner side of the goggle frame, wherein said magnetic portions are separably or inseparably attached to the inner side of the frame and have an opposite polarity to each other, and characterized in that the magnetic attachment means of the coupling device comprise two magnetic portions with opposite polarity to each other which are arranged to have in turn an opposite polarity with the magnetic portions disposed on the goggle frame, the magnetic portions being separably or inseparably attached to the base portion which is shaped like a protection rubber with a "U" cross-section for adhering to the edge of the shell of the protective helmet and which are disposed at the both sides of the facial aperture, wherein the magnetic portions of the frame have surfaces having a shape which fits completely with the surfaces of the magnetic portions of the coupling device, further characterized in that the griping means comprise at least one elongation disposed outwardly at the lateral ends of the frame outside the visual space of the lens, and further characterized in that the elongation comprises a hole as a handle at its distal end.

A goggle frame is releasably attachable to the facial aperture of protective helmets provided with a coupling device comprising magnetic attachment means for the attachment, characterized in that the goggle frame comprises magnetic attachment means arranged correlatively with the magnetic attachment means comprised in the coupling device of the helmet to create a magnetic attraction sufficient to allow magnetic releasable coupling between the goggle frame and the coupling device and wherein the goggle frame is further characterized in that it comprises griping means, further characterized in that said magnetic attachment means comprise at least a portion with magnetic or magnetizable material detachably or inseparably attached to the part or inner side of the frame whose surface has a shape completely attachable with the magnetic attachment means of the device.

A goggle frame is releasably attachable to the facial aperture of protective helmets provided with a coupling device comprising magnetic attachment means for the attachment, characterized in that the goggle frame comprises magnetic attachment means arranged correlatively with the magnetic attachment means comprised in the coupling device of the helmet to create a magnetic attraction sufficient to allow magnetic releasable coupling between the goggle frame and the coupling device and wherein the goggle frame is further characterized in that it comprises griping means, further characterized in that said magnetic portion is obtained in elastomer material with injected magnet.

A goggle frame is releasably attachable to the facial aperture of protective helmets provided with a coupling device comprising magnetic attachment means for the attachment, characterized in that the goggle frame comprises magnetic attachment means arranged correlatively with the magnetic attachment means comprised in the coupling device of the helmet to create a magnetic attraction sufficient to allow magnetic releasable coupling between the goggle frame and the coupling device and wherein the goggle frame is further characterized in that it comprises griping means, further characterized in that the griping means comprise at least one elongation disposed outwardly outside the visual space of the lens.

A goggle frame is releasably attachable to the facial aperture of protective helmets provided with a coupling device comprising magnetic attachment means for the attachment, characterized in that the goggle frame comprises magnetic attachment means arranged correlatively with the magnetic attachment means comprised in the coupling device of the helmet to create a magnetic attraction sufficient to allow magnetic releasable coupling between the goggle frame and the coupling device and wherein the goggle frame is further characterized in that it comprises griping means, further characterized in that the griping means comprise at least one elongation disposed outwardly outside the visual space of the lens, and further characterized in that said elongation comprises a handle-like hole at its distal end.

A coupling device for coupling of a goggle frame to the facial aperture of protective helmets, the goggle frame being provided with magnetic attachment means, characterized in that the coupling device comprises magnetic attachment means arranged correlatively with the magnetic attachment means comprised in the goggle frame and in that it consists of one or more bodies comprising a base portion configured to be wholly or partially disposed in the facial aperture of the protective helmet comprising fixation or adhesion means, further characterized in that it is obtained in elastomer material and in that the magnetic attachment means comprise at least one portion comprising magnetic or magnetizable material, said portion being separably or inseparably attached to the base portion.

A coupling device for coupling of a goggle frame to the facial aperture of protective helmets, the goggle frame being provided with magnetic attachment means, characterized in that the coupling device comprises magnetic attachment means arranged correlatively with the magnetic attachment means comprised in the goggle frame and in that it consists of one or more bodies comprising a base portion configured to be wholly or partially disposed in the facial aperture of the protective helmet comprising fixation or adhesion means, further characterized in that it is obtained in elastomer material and in that the magnetic attachment means comprise at least one portion comprising magnetic or magnetizable material, said portion being separably or inseparably attached to the base portion, further characterized in that the portion comprised in the magnetic attachment means are two portions obtained in elastomer material with injected magnet with the opposite polarity to each other and in that both portions are attached separably or inseparably to the base portion characterized in that it is shaped as a profile rubber with a "U" cross-section for adhering to the edge of the shell disposed at the lateral ends of the facial aperture of the protective helmet.

A coupling device for coupling of a goggle frame to the facial aperture of protective helmets, the goggle frame being provided with magnetic attachment means, characterized in that the coupling device comprises magnetic attachment means arranged correlatively with the magnetic attachment means comprised in the goggle frame and in that it consists of one or more bodies comprising a base portion configured to be wholly or partially disposed in the facial aperture of the protective helmet comprising fixation or adhesion means, further characterized in that the base portion is made of elastomeric material and configured as a covering of the internal lining of the helmet or of the helmet padding.

A goggle frame is releasably attachable to the facial aperture of protective helmets provided with a coupling device comprising magnetic attachment means for the attachment, characterized in that the goggle frame comprises magnetic attachment means arranged correlatively with the magnetic attachment means comprised in the coupling device of the helmet to create a magnetic attraction sufficient to allow magnetic releasable coupling between the goggle frame and the coupling device and wherein the goggle frame is further characterized in that it comprises griping means, further characterized in that said magnetic attachment means comprise at least a magnetic or magnetizable portion which is separately or inseparably attached to a base portion, said base portion being the frame itself or any detachable part thereof.

A goggle frame and coupling device for coupling the goggle frame to a facial aperture of a protective helmet, the goggle frame and coupling device comprises a goggle frame, the goggle frame comprising a right side frame magnetic portion and a left side frame magnetic portion on an inner side of the goggle frame or a detachable part thereof, wherein the right side frame magnetic portion and the left side frame magnetic portion are of opposite polarity, and a coupling device, the coupling device comprising a right side coupling device magnetic portion and a left side coupling device magnetic portion, the right side coupling device magnetic portion and the left side coupling device magnetic portion being attached to a U-shaped base portion, wherein the U-shaped base portion is disposable on an edge of the facial aperture of the protective helmet, wherein the right side frame magnetic portion, the left side frame magnetic portion, the right side coupling device magnetic portion, and the left side coupling device magnetic portion together form a magnetic attachment means arranged correlatively to create a magnetic attraction sufficient to allow magnetic engagement of the goggle frame with the coupling device, wherein the right side frame magnetic portion and the right side coupling device magnetic portion have opposite polarity and wherein the left side frame magnetic portion and the left side coupling device magnetic portion have opposite polarity, and wherein the goggle frame comprises gripping means configured to be gripped by a user for magnetic disengagement of the goggle frame from the coupling device.

A goggle frame and coupling device for coupling the goggle frame to a facial aperture of a protective helmet, the goggle frame and coupling device comprises a goggle frame, the goggle frame comprising a right side frame magnetic portion and a left side frame magnetic portion on an inner side of the goggle frame or a detachable part thereof, wherein the right side frame magnetic portion and the left side frame magnetic portion are of opposite polarity, and a coupling device, the coupling device comprising a right side coupling device magnetic portion and a left side coupling device magnetic portion, the right side coupling device magnetic portion and the left side coupling device magnetic portion being attached to a base portion which is adapted to be fixed to or adhere to the protective helmet, wherein the right side frame magnetic portion, the left side frame magnetic portion, the right side coupling device magnetic portion, and the left side coupling device magnetic portion together form a magnetic attachment means arranged correlatively to create a magnetic attraction sufficient to allow magnetic engagement of the goggle frame with the coupling device, wherein the right side frame magnetic portion and the right side coupling device magnetic portion have opposite polarity and wherein the left side frame magnetic portion and the left side coupling device magnetic portion have opposite polarity, and wherein the goggle frame comprises gripping means configured to be gripped by a user for magnetic disengagement of the goggle frame from the coupling device.

A protective helmet, goggle frame and coupling device for coupling the goggle frame to a facial aperture of the protective helmet, the protective helmet, goggle frame and coupling device comprises a protective helmet comprising a facial aperture; a goggle frame, the goggle frame comprising a right side frame magnetic portion and a left side frame magnetic portion on an inner side of the goggle frame or a detachable part thereof, wherein the right side frame magnetic portion and the left side frame magnetic portion are of opposite polarity, and a coupling device, the coupling device comprising a right side coupling device magnetic portion and a left side coupling device magnetic portion, the right side coupling device magnetic portion and the left side coupling device magnetic portion being attached to a base portion which is adapted to be fixed to or adhere to the protective helmet, wherein the right side frame magnetic portion, the left side frame magnetic portion, the right side coupling device magnetic portion, and the left side coupling device magnetic portion together form a magnetic attachment means arranged correlatively to create a magnetic attraction sufficient to allow magnetic engagement of the goggle frame with the coupling device, wherein the right side frame magnetic portion and the right side coupling device magnetic portion have opposite polarity and wherein the left side frame magnetic portion and the left side coupling device magnetic portion have opposite polarity, and wherein the goggle frame comprises gripping means configured to be gripped by a user for magnetic disengagement of the goggle frame from the coupling device.

BRIEF DESCRIPTION OF THE DRAWINGS

To complement the description and in order to aid in a better understanding of the features of the invention, there is attached as an integral part of said description, a set of drawings in which, for illustrative and non-limiting purposes, the following has been represented.

DESCRIPTION

Figure 1:
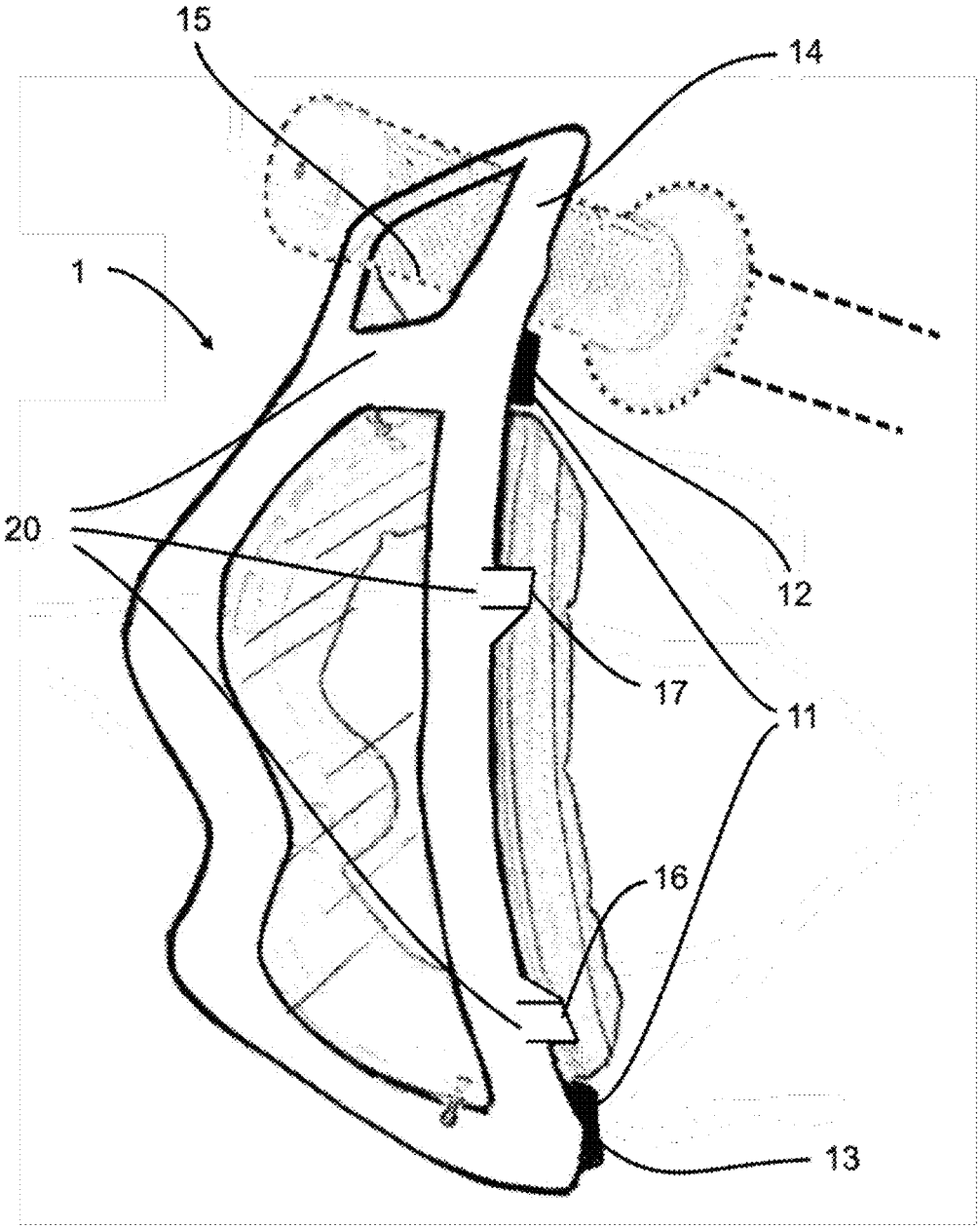
FIG. 1 shows a perspective view of an embodiment of a goggle frame of the invention.

FIG. 1 shows a view of an embodiment of a goggle frame 1 of the invention hanging from a handlebar grip of a motorcycle that passes through a hole 15 disposed in an elongation 14 of the goggle frame 1 disposed on the outer right side of the goggle frame 1. Also visible are magnetic attachment means 11 attached to the inner side of the goggle frame 1 which comprise a magnet 12 of negative polarity at its right end a magnet 13 of positive polarity at its left end, both of neodymium inserted in elastomeric material with the same rectangular shape and with round edges. The goggle frame 1 has a gripping means 20 including the elongation 14 and hole 15 and upper frame elongations 16, 17.

Figure 2:
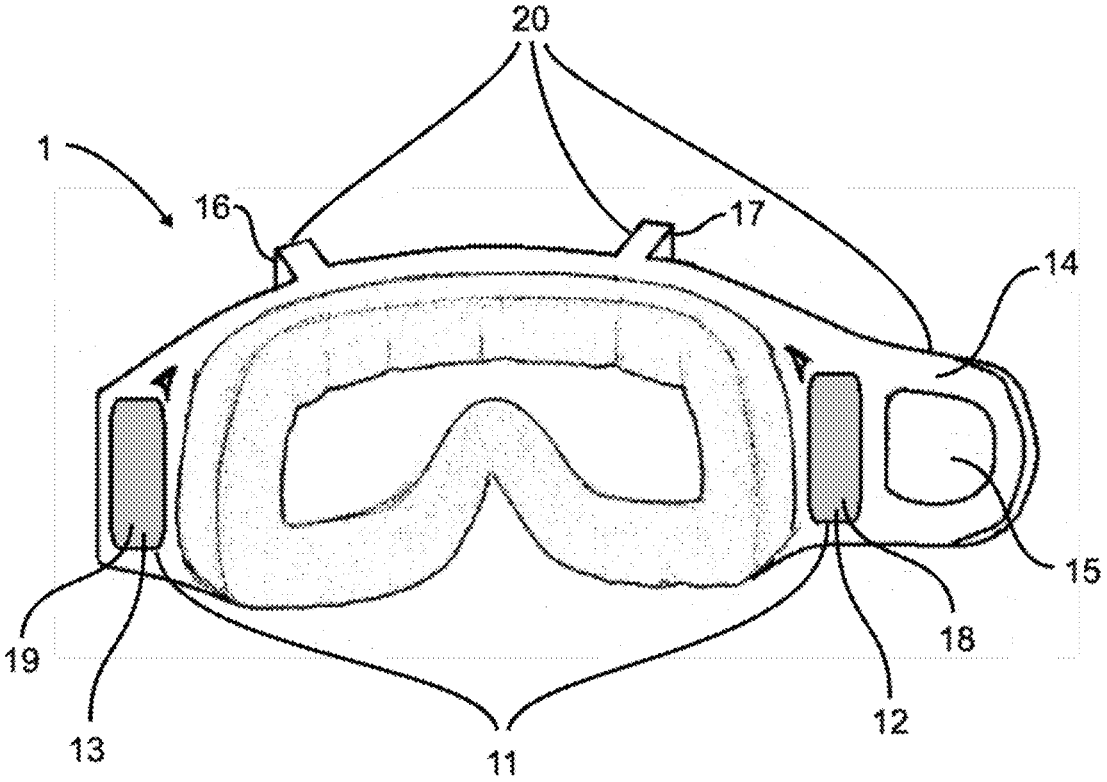
FIG. 2 shows a rear view of the inner side of an embodiment of a goggle frame of the invention.

FIG. 2 shows a view of the inner side of a preferred embodiment of the goggle frame 1 comprising at the most distal ends from each other magnetic coupling means 11 on the inner side of the frame 1 featuring a flat right side magnetic portion 18 at its right end and another flat left side frame magnetic portion 19 at its left end both with the same rectangular shape with round edges in which the injected magnets 12, 13 are disposed.

Figure 3:
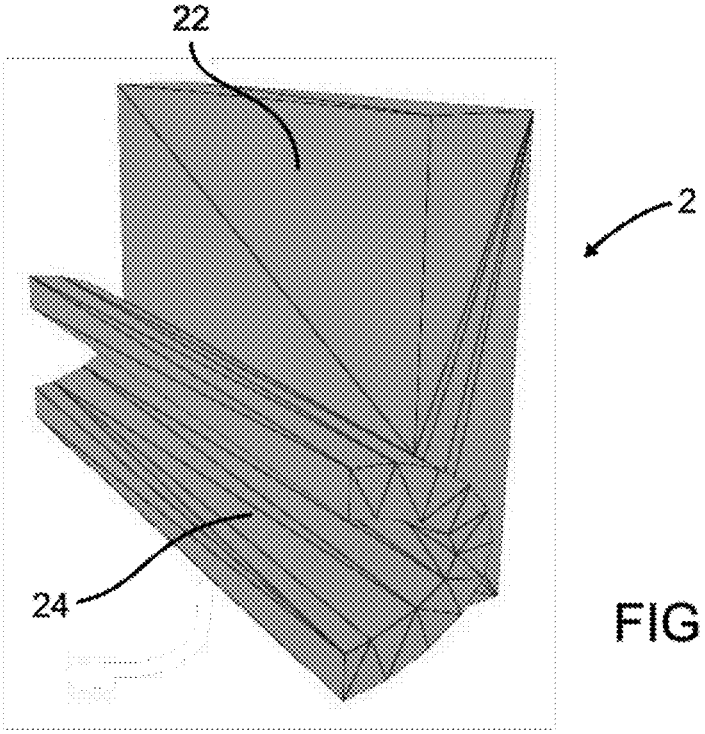
FIG. 3 shows a cross section of a portion of a coupling device of the invention.

FIG. 3 shows a cross section of a preferred embodiment of a coupling device 2 having a base portion 24 having a "U" shape that allows it to be permanently attached to the edge of a shell of a protective helmet. The base portion 24 is attached to a right side coupling device magnetic portion 22, with a flat surface and rectangular shape containing the injected magnets.

Figure 4:
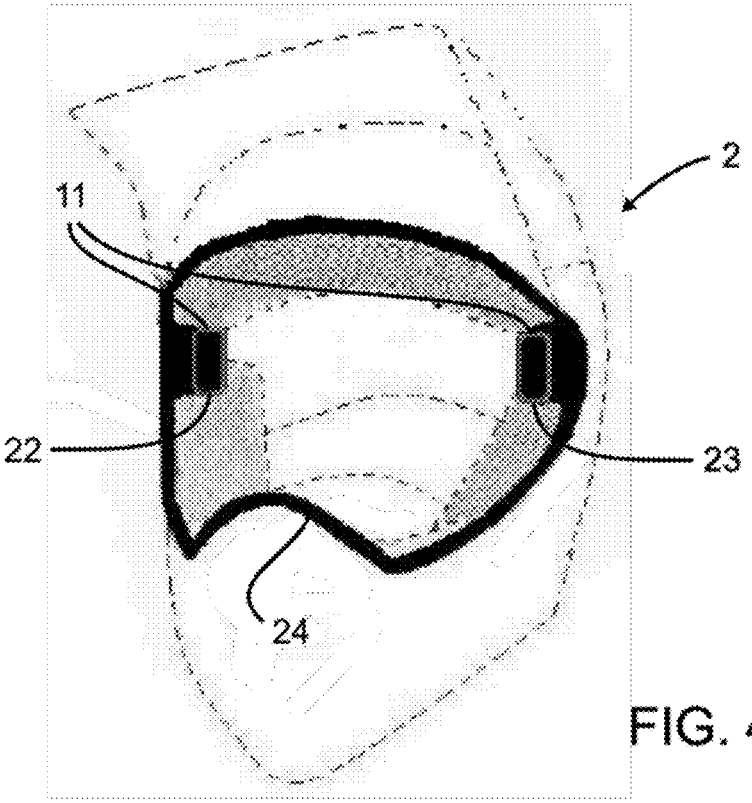
FIG. 4 shows a perspective view of a coupling device of the invention attached to a protective helmet.

FIG. 4 shows a view of a preferred embodiment of the coupling device 2 of the invention where the base portion 24 of the coupling device 2 is attached to a protective helmet in its facial aperture zone. The magnetic attachment means 11 includes a right side coupling device magnetic portion 22 and a left side coupling device magnetic portion 23 attached to the same "U" shaped base portion 24 covering the edge of the shell in the area of its facial aperture. The right side coupling device magnetic portion 22 has a positive polarity and couples with the right side frame magnetic portion 18 which includes the magnet 12 of negative polarity of the goggle frame 1, while the left side coupling device magnetic portion 23 has a negative polarity and couples with the left side frame magnetic portion 19 which includes the magnet 13 of positive polarity of the goggle frame 1.

Figure 5:
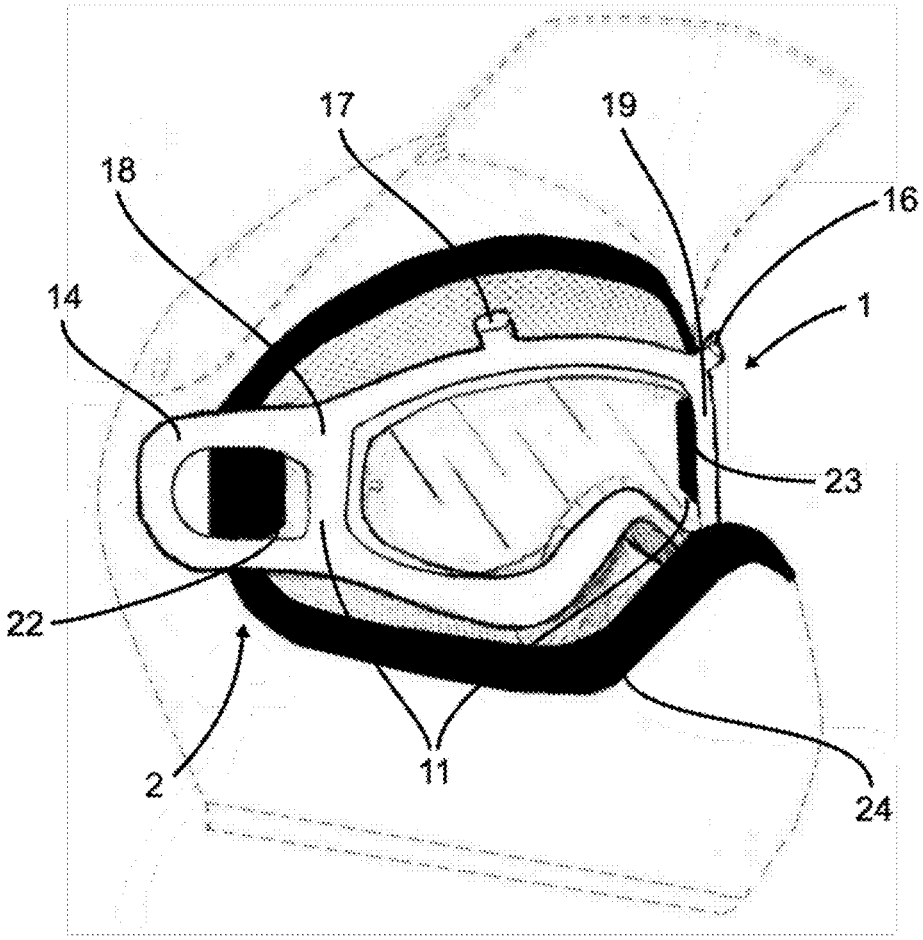
FIG. 5 shows a perspective view of an embodiment of a goggle frame of the invention and a coupling device of the invention on a protective helmet.

FIG. 5 shows a view of a preferred embodiment of the google frame 1 and the coupling device 2 of the invention in use, with the protective goggle frame 1 provided with magnetic attachment means 11 and engaged into the facial aperture of a motocross protective helmet by means of the magnetic attraction created by the opposite poles of the magnetic attachment means 11 of the goggle frame 1 and the coupling device 2. The base portion 24 of the coupling device 2 having the "U" shape like rubber covering the profile of the shell in the area of its facial aperture to which are attached the two coupling device magnetic portions 22 and 23 of flat surface disposed at the height of the temple at the left and right ends. All magnetic portions are made of elastomeric material with injected magnet.

Figure 6:
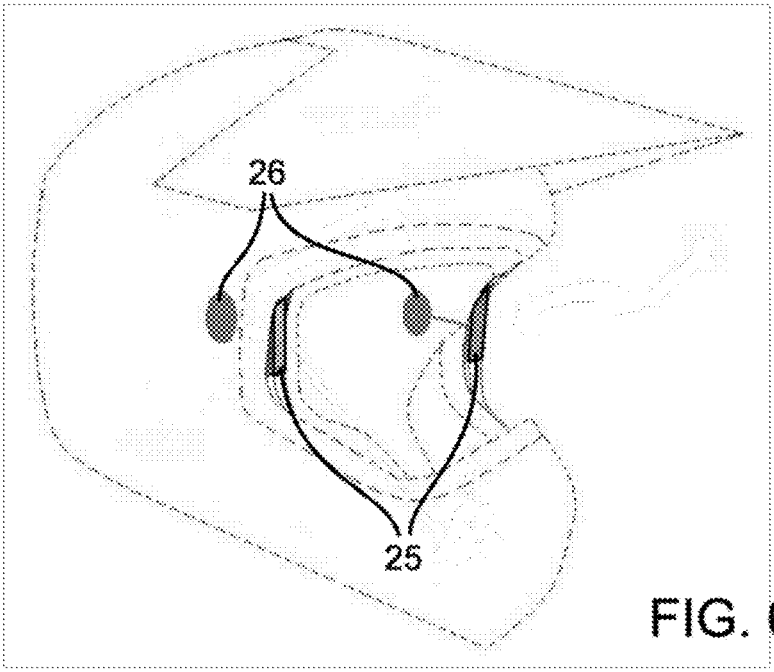
FIG. 6 shows another embodiment of a coupling device of the invention on a protective helmet.

FIG. 6 shows a view of another embodiment of the coupling device 2 of the present invention. In this embodiment, two bodies made of elastomeric material which comprise a flat magnetic portion 25 of rectangular shape where the magnets are inserted or injected and which constitutes the magnetic attachment means are attached to a base portion 26 with a shape of a flat pendulum which adheres to the surface of the inner shell of the protective helmet by means of a high strength adhesive which constitutes the fixation or adhesion means.

Figure 7:
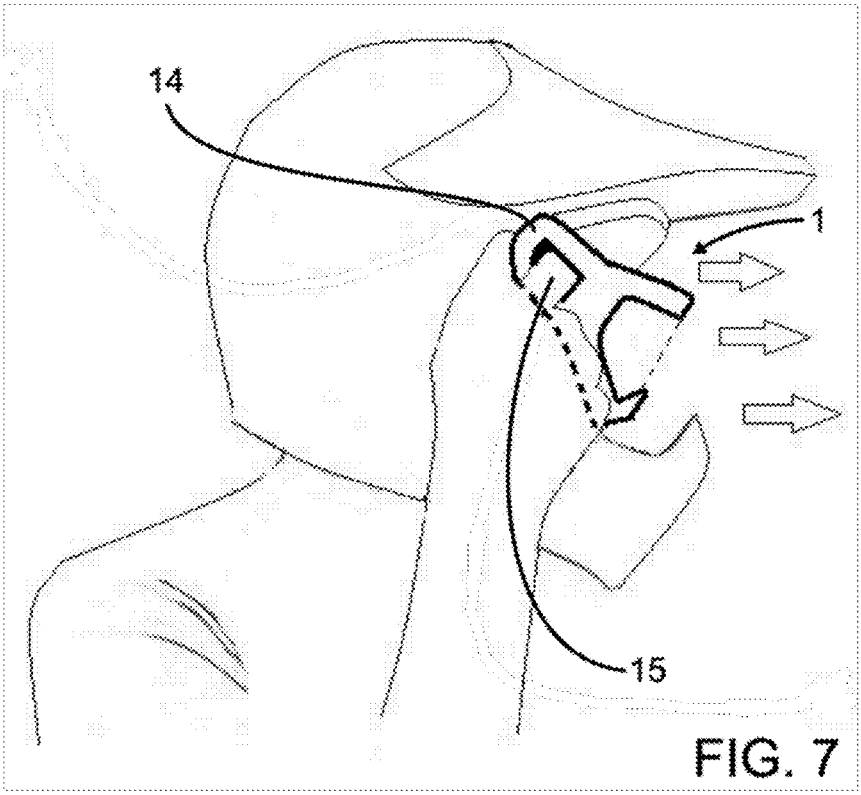
FIG. 7 shows a side view of a goggle frame of the invention being disengaged from a protective helmet.

FIG. 7 shows a side view of a preferred embodiment of the goggle frame 1 invention during the moment when a rider pulls the right-side elongation 14 of the goggle frame 1 by inserting a thumb into the hole 15 to release the goggle frame 1 from the coupling device 2 and thus disengage the goggle frame 1 from the facial aperture of the helmet.

Figure 8:
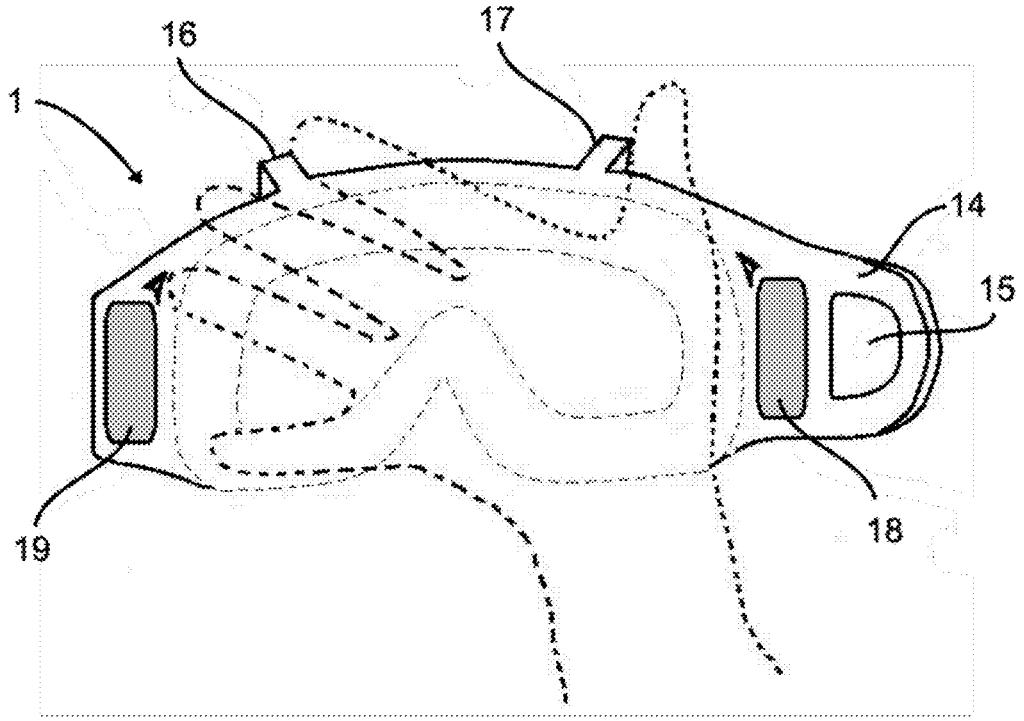
FIG. 8 shows a rear view of a goggle frame of the invention being gripped with one hand for coupling the goggle frame.

FIG. 8 shows a preferred embodiment of the goggle frame 1 of the invention being gripped with one hand for coupling using the thumb to press the upper frame elongation 17 towards the center of the goggle frame 1 and the index and middle fingers with each other to grip the upper frame elongation 16, all without touching the lens or the edges of the goggle frame 1.

PREFERRED EMBODIMENT OF THE INVENTION

The goggle frame is indicated by reference numeral 1 and the coupling device for its attachment to the facial aperture of protective helmets is indicated by reference numeral 2.

As can be appreciated in FIG. 5, the present invention, in its preferred embodiment, comprises a goggle frame 1 and a coupling device 2, wherein the frame 1 comprises an elongation 14 on the outer side of the frame, on its right side, shaped like a tab, by way of prolongation of the goggle frame 1 with the same curved direction, and which has a hole or perforation 15 sufficient to allow the handlebar grip of a motorcycle to pass through. The goggle frame 1 also has two upper elongations 16 and 17 centrally disposed on the upper side of the outer side of the goggle frame 1 and which are equidistantly separated from each other by a distance of five centimeters. The inner side of the goggle frame 1 comprises magnetic attachment means 11 composed of a flat right side frame magnetic portion 18 with a magnet 12 of negative polarity disposed at its right end and a left side frame flat magnetic portion 19 with a magnet 13 of positive polarity disposed at its left end, both portions separably or inseparably attached to the goggle frame 1 itself or any detachable part thereof with rectangular shape with rounded edges, with dimensions of 2.0 cms wide, 3.5 cms long and which are made with magnet injected in the plastic itself of the inner side of the goggle frame 1. The frame magnetic portions 18 and 19 constitute a contact surface with the coupling device 2. The coupling device 2 is composed of a "U" shaped base portion 24 covering the entire edge of the shell of a protective helmet in the area of its facial aperture. The "U" shaped base portion is inseparably attached to the helmet by means of a high strength adhesive and is releasably attached to right side coupling device magnetic portion 22 with a flat surface that couples with the equally flat right side frame magnetic portion 18 of negative polarity of the goggle frame 1 and having a positive polarity. The "U" shaped base portion is also releasably attached to flat left side coupling device magnetic portion 23 which couples with an equally flat left side frame magnetic portion 19 or positive polarity of the frame 1 and having a negative polarity. Both coupling device magnetic portions 22, 23 being rectangular in shape with rounded edges, with dimensions of 2.0 cm wide, 3.5 cm long, and 0.5 cm thick, which are made of elastomeric material with injected magnet and constitute the contact surface with the goggle frame 1.

The invention claimed is:

1. A goggle frame and coupling device for coupling the goggle frame to a facial aperture of a protective helmet, the goggle frame and coupling device comprising:

a goggle frame, the goggle frame comprising a right side frame magnetic portion and a left side frame magnetic portion on an inner side of the goggle frame or a detachable part thereof, wherein the right side frame magnetic portion and the left side frame magnetic portion are of opposite polarity, and a coupling device, the coupling device comprising a right side coupling device magnetic portion and a left side coupling device magnetic portion, the right side coupling device magnetic portion and the left side coupling device magnetic portion being attached to a U-shaped base portion, wherein the U-shaped base portion is disposable on an edge of the facial aperture of the protective helmet, wherein the right side frame magnetic portion, the left side frame magnetic portion, the right side coupling device magnetic portion, and the left side coupling device magnetic portion together form a magnetic attachment means arranged correlatively to create a magnetic attraction sufficient to allow magnetic engagement of the goggle frame with the coupling device, wherein the right side frame magnetic portion and the right side coupling device magnetic portion have opposite polarity and wherein the left side frame magnetic portion and the left side coupling device magnetic portion have opposite polarity, and wherein the goggle frame comprises gripping means configured to be gripped by a user for magnetic disengagement of the goggle frame from the coupling device.

2. A goggle frame and coupling device according to claim 1 wherein the magnetic attachment means is separably attached to the frame and the coupling device.

3. A goggle frame and coupling device according to claim 1 wherein the right side frame magnetic portion, the left side frame magnetic portion, the right side coupling device magnetic portion, and the left side coupling device magnetic portion are each elastomer material with an injected or inserted magnet.

4. A goggle frame and coupling device according to claim 1 wherein the gripping means comprises an elongation of the goggle frame disposed on the side of the goggle frame.

5. A goggle frame and coupling device according to claim 1 wherein the gripping means comprises an elongation of the goggle frame disposed on the side of the goggle frame, the elongation including a hole through which a thumb can be inserted.

6. A goggle frame and coupling device for coupling the goggle frame to a facial aperture of a protective helmet, the goggle frame and coupling device comprising:

a goggle frame, the goggle frame comprising a right side frame magnetic portion and a left side frame magnetic portion on an inner side of the goggle frame or a detachable part thereof, wherein the right side frame magnetic portion and the left side frame magnetic portion are of opposite polarity, and a coupling device, the coupling device comprising a right side coupling device magnetic portion and a left side coupling device magnetic portion, the right side coupling device magnetic portion and the left side coupling device magnetic portion being attached to a base portion which is adapted to be fixed to or adhere to the protective helmet, wherein the right side frame magnetic portion, the left side frame magnetic portion, the right side coupling device magnetic portion, and the left side coupling device magnetic portion together form a magnetic attachment means arranged correlatively to create a magnetic attraction sufficient to allow magnetic engagement of the goggle frame with the coupling device, wherein the right side frame magnetic portion and the right side coupling device magnetic portion have opposite polarity and wherein the left side frame magnetic portion and the left side coupling device magnetic portion have opposite polarity, and wherein the goggle frame comprises gripping means configured to be gripped by a user for magnetic disengagement of the goggle frame from the coupling device, wherein the gripping means comprises an elongation of the goggle frame disposed on the side of the goggle frame, the elongation including a hole configured to receive an inserted thumb.

7. A protective helmet, goggle frame and coupling device for coupling the goggle frame to a facial aperture of the protective helmet, the protective helmet, goggle frame and coupling device comprising:

a protective helmet comprising a facial aperture;

a goggle frame, the goggle frame comprising a right side frame magnetic portion and a left side frame magnetic portion on an inner side of the goggle frame or a detachable part thereof, wherein the right side frame magnetic portion and the left side frame magnetic portion are of opposite polarity, and a coupling device, the coupling device comprising a right side coupling device magnetic portion and a left side coupling device magnetic portion, the right side coupling device magnetic portion and the left side coupling device magnetic portion being attached to a base portion which is adapted to be fixed to or adhere to the protective helmet, wherein the right side frame magnetic portion, the left side frame magnetic portion, the right side coupling device magnetic portion, and the left side coupling device magnetic portion together form a magnetic attachment means arranged correlatively to create a magnetic attraction sufficient to allow magnetic engagement of the goggle frame with the coupling device, wherein the right side frame magnetic portion and the right side coupling device magnetic portion have opposite polarity and wherein the left side frame magnetic portion and the left side coupling device magnetic portion have opposite polarity, and wherein the goggle frame comprises gripping means configured to be gripped by a user for magnetic disengagement of the goggle frame from the coupling device, wherein the gripping means comprises an elongation of the goggle frame disposed on the side of the goggle frame, the elongation including a hole configured to receive an inserted thumb.

* * * * *